US005685651A

United States Patent [19]

Hayman et al.

[11] Patent Number: 5,685,651

[45] Date of Patent: Nov. 11, 1997

[54] PRINTING DEVICE

[75] Inventors: James A. Hayman, Sevenoaks; Charles R. Sims, Royston, both of England

[73] Assignee: Esselte N.V., St Niklaas, Belgium

[21] Appl. No.: 340,007

[22] Filed: Nov. 15, 1994

Related U.S. Application Data

[63] Continuation of Ser. No. 42,355, Apr. 2, 1993, abandoned.

[30] Foreign Application Priority Data

Apr. 2, 1992 [GB] United Kingdom ..... 9207287

[51] Int. Cl.[6] ..... B41J 3/36

[52] U.S. Cl. ..... 400/88; 400/691; 347/109

[58] Field of Search ..... 400/88, 31, 691; 346/143; 347/37, 109

[56] References Cited

U.S. PATENT DOCUMENTS

| | | | |
|---|---|---|---|
| 4,377,741 | 3/1983 | Brekka et al. | 235/472 |
| 4,378,564 | 3/1983 | Cross et al. | 400/126 |
| 4,412,232 | 10/1983 | Weber et al. | 400/126 |
| 4,436,439 | 3/1984 | Koto | 400/126 |
| 5,162,916 | 11/1992 | Stemmle et al. | 358/296 |
| 5,251,555 | 10/1993 | Speicher | 101/93.04 |

FOREIGN PATENT DOCUMENTS

| | | | |
|---|---|---|---|
| 56-67280 | 6/1981 | Japan | 400/88 |
| 61-175056 | 8/1986 | Japan . | |
| 2 002 694 | 2/1979 | United Kingdom . | |
| WO92/16375 | 10/1992 | WIPO . | |

*Primary Examiner*—Ren Yan

*Attorney, Agent, or Firm*—Pennie & Edmonds LLP

[57] ABSTRACT

A printing device includes a portable body having support means within which is defined a print face. The support means is capable of abutment against a surface on which an image is to be printed so that the print face is exposed to the surface and defines a region over which print is to be distributable without relative movement of the print face and said surface. The support means is arranged to support spaced from the surface to be printed an ink jet print head for distributing said print, and the ink jet print head is selectively operable at a plurality of locations within the print face to print an image onto the surface to be printed. The device has an electronic control device including a buffer for holding data defining at least part of the image and print actuating means controlled by the control device for operating the ink jet print head to print an image.

10 Claims, 4 Drawing Sheets

PRINTING DEVICE

This is a continuation, of application Ser. No. 08/042, 355, filed Apr. 2, 1993, now abandoned.

This invention relates to a printing device, particularly but not exclusively for the printing of addresses onto envelopes, parcels etc.

BACKGROUND OF THE INVENTION

Currently, envelopes are addressed in one of several ways. Office personnel will either use printers for producing a sheet of labels, write envelopes by hand, use window envelopes through which an address typed on a letter is visible, use a conventional typewriter either to type the address on the envelope itself or to produce a label, or use pre-addressed labels.

Problems exist with each of these conventionally used methods and the present invention has been developed with a view to enabling envelopes and other items to be addressed simply and economically.

SUMMARY OF THE INVENTION

According to the present invention there is provided a printing device comprising a portable body having support means within which is defined a print face, the support means being capable of abutment against a surface on which an image is to be printed so that the print face is exposed to the surface and defines a region over which print is to be distributable without relative movement of the print face and said surface, the support means being arranged to support spaced from said surface an ink supply mechanism for distributing said print, wherein the ink supply mechanism is selectively operable at a plurality of locations within the print face to print an image onto said surface, the device further having electronic control means including store means for holding data defining at least part of the image and print actuating means controlled by the control means for operating the ink supply mechanism to print an image.

The printing device can be held either substantially horizontally on top of a surface to be printed or it can be held vertically against the surface to be printed. In either case, the ink supply mechanism is held away from the surface to be printed.

Preferably, the ink supply mechanism comprises an ink-jet print head.

Preferably, the printing device has means for coupling the store means thereof to a computer terminal from which data can be transmitted for printing. When the printing device is linked to a computer in this manner, the computer can provide all the necessary commands to print an address. Optionally, the computer connection can also be used to provide power directly or to recharge internal batteries. The printing device can be provided in combination with a holder for mounting the printing device to a computer terminal.

For a better understanding of the present invention and to show how the same may be carried into effect, reference will now be made by way of example to the accompanying drawings, in which:

DESCRIPTION OF THE PREFERRED EMBODIMENT

Figure 1:
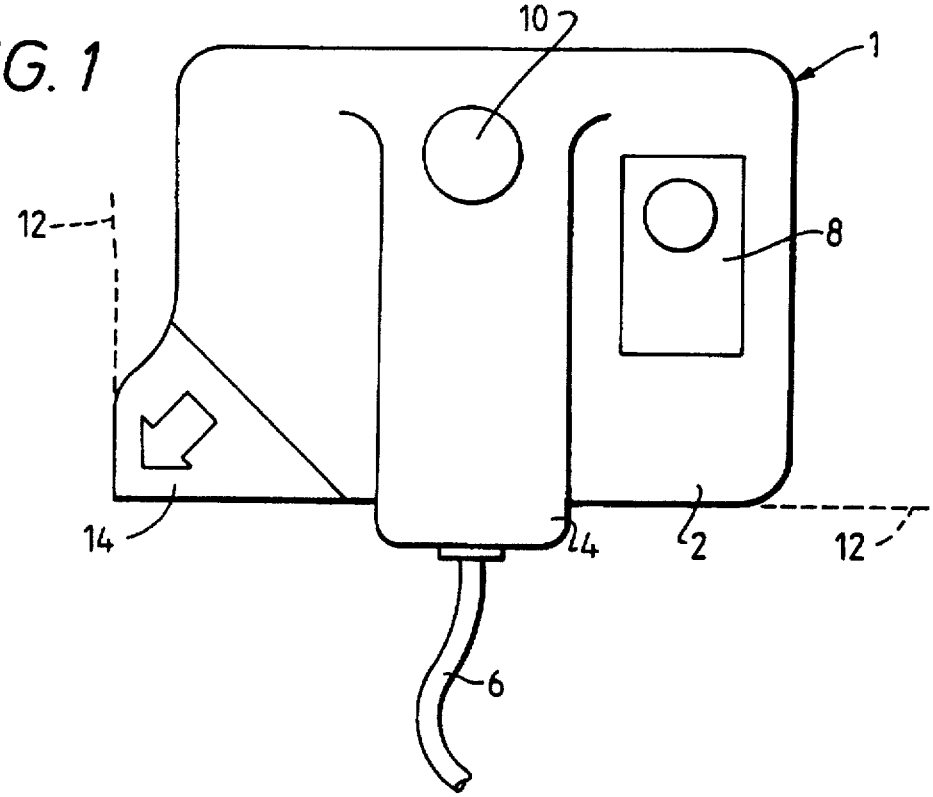
FIG. 1 is a view from above of a printing device in accordance with one embodiment.
Figure 2:
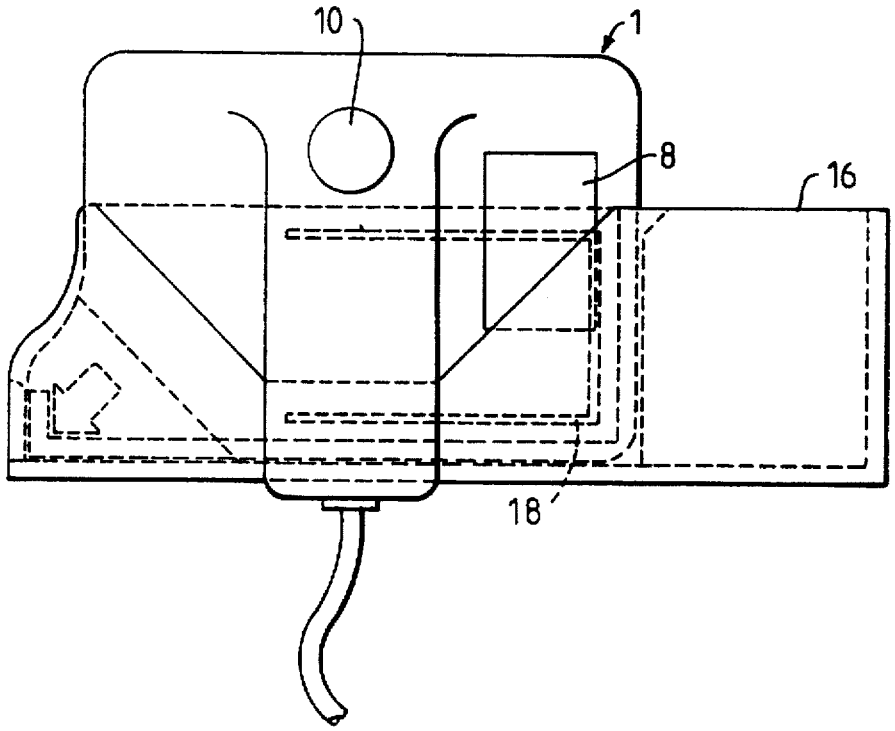
FIG. 2 shows the printing device of FIG. 1 when mounted in a holder.
Figure 3:
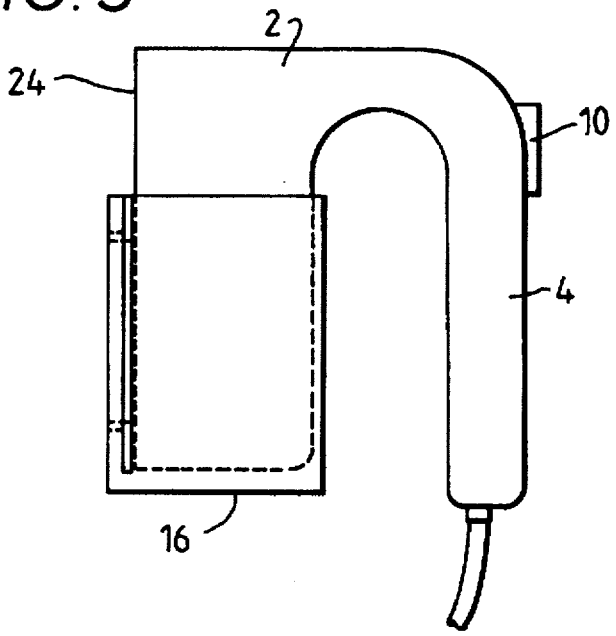
FIG. 3 is a view from the side of the device of FIG. 2.
Figure 4:
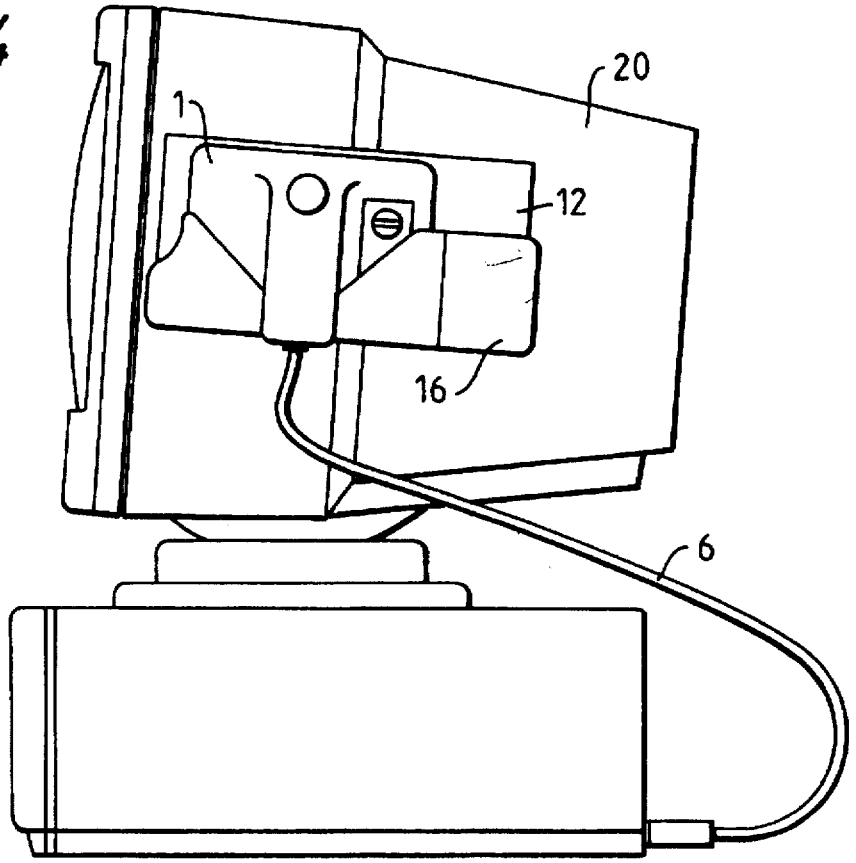
FIG. 4 is a sketch showing the printing device and holder mounted on a computer terminal.

FIG. 1 shows a printing device 1 having a portable body 2. The body 2 has a handle 4 by means of which the body 2 can be carried. The handle 4 carries a cable 6 for connecting the printing device 1 to a computer terminal or word processor terminal. The body 2 carries a cartridge release mechanism 8 the function of which will be described hereinafter. The body 2 also carries a print actuating means in the form of a button 10 which when depressed causes a printing operation to be executed. As can be seen in FIG. 3, the body 2 has a supporting wall 22 defining a print face 24 opposite the handle 4. The device is intended to be held with the supporting wall 22 abutting a surface on which an image is to be printed. In FIG. 1, this surface is an envelope indicated diagrammatically by dotted lines 12. The printing device 1 has alignment means enabling the printing device to be aligned against one corner of the envelope. In FIG. 1 the device is shown placed on a horizontal surface, but it is equally capable of operating when arranged vertically as shown in FIGS. 2 and 3. In FIG. 2, the printing device 1 is shown mounted in a holder 16 which itself is intended to be mounted on a word processor or computer terminal as illustrated for example in FIG. 4. The holder 16 has a plastic spring 18 to ensure correct positioning of the envelope when inserted in the holder. FIG. 3 is a side view of the arrangement shown in FIG. 2 which demonstrates how the handle 4 can be used to remove and replace the printing device from the holder in a simple manner. Furthermore, the print actuating button 10 is provided on the handle so as to be readily actuatable by a user. FIG. 4 illustrates the holder 16 mounted on the side of a computer or word processor terminal 20. An envelope 12 is inserted into the holder 16 and is held in place by the plastic clip 18. The envelope 12 is thus supported adjacent the print face of the printing device 1. The printing device 1 is coupled to the word processor terminal by means of the cable 6 to enable data to be printed to be transferred from the word processor memory to the printing device.

Figure 5:
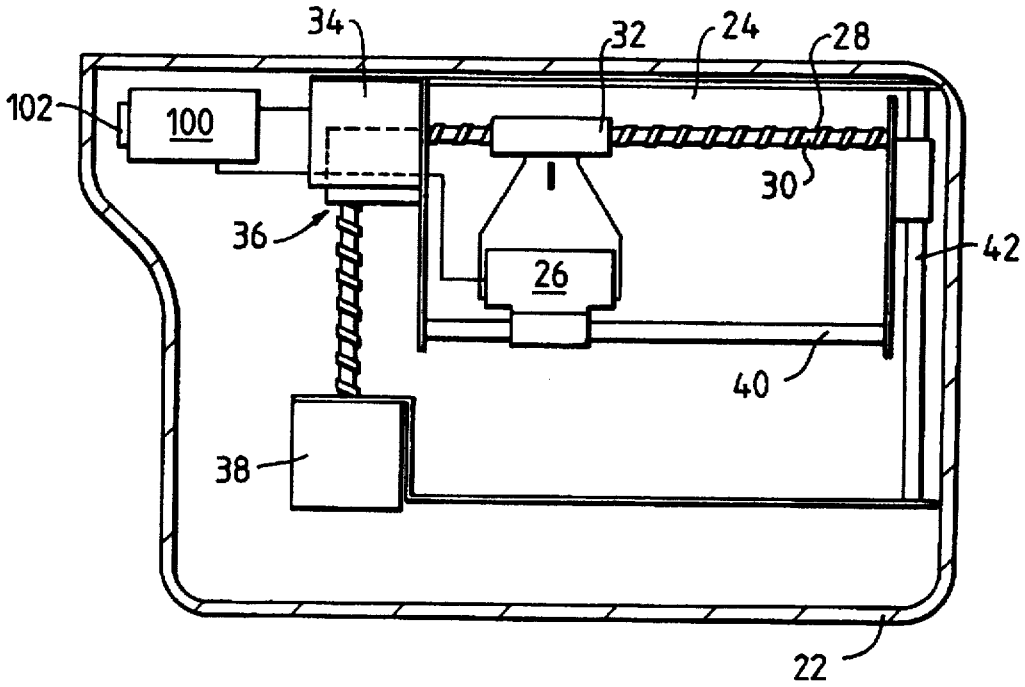
FIG. 5 is a view from beneath the printing device of FIG. 1.
Figure 6:
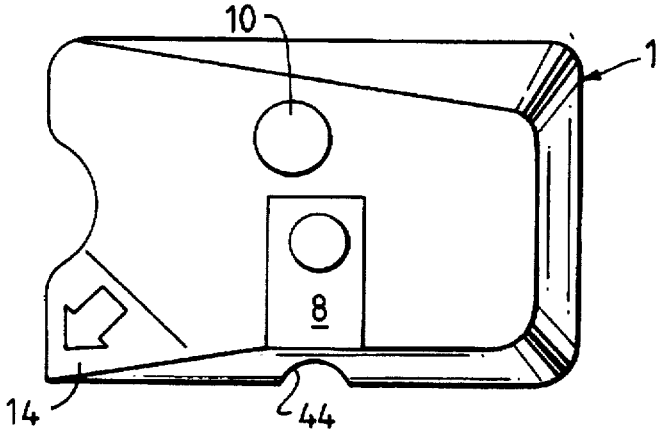
FIG. 6 is a plan view of a printer device in accordance with a second embodiment of the invention.
Figure 7:
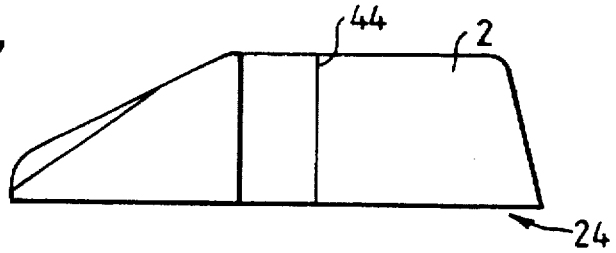
FIG. 7 is a view from the side of the device of FIG. 6.
Figure 8:
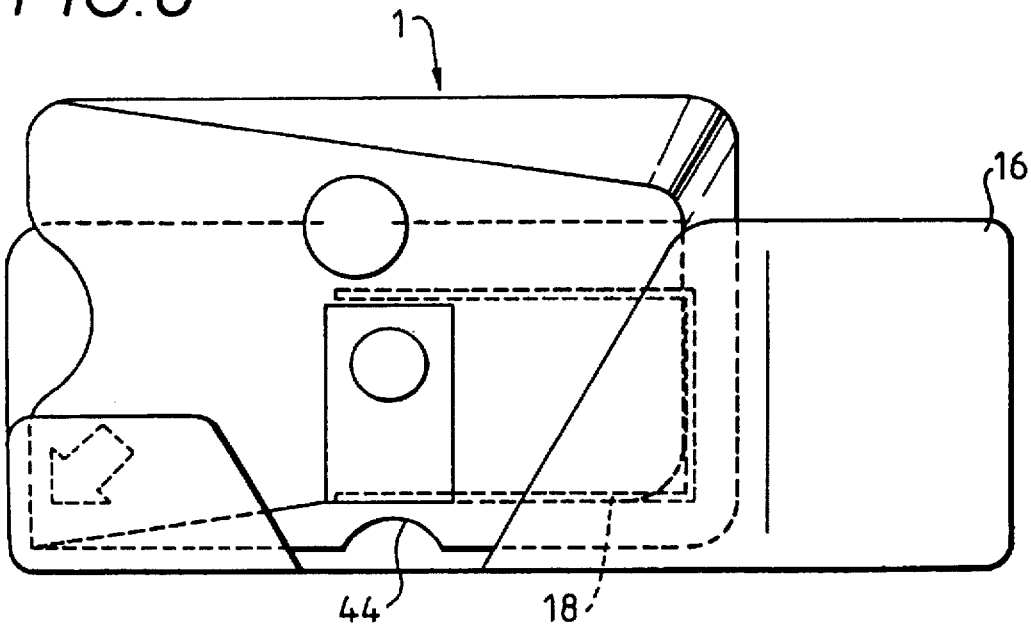
FIG. 8 is a view of the device of FIG. 6 mounted in a holder.
Figure 9:
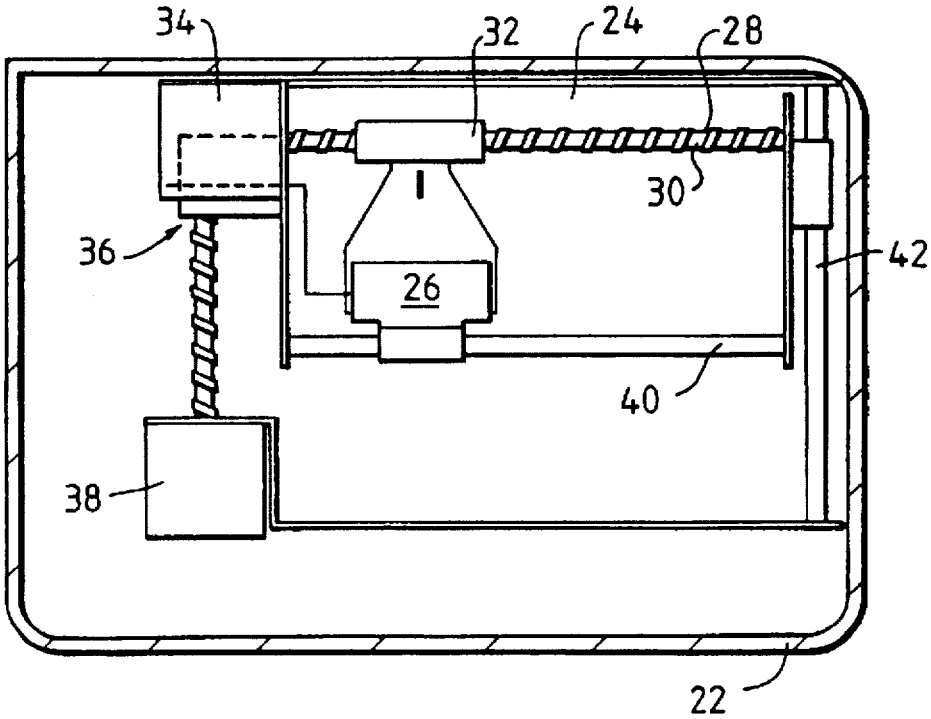
FIG. 9 is a view from beneath the printing device of FIG. 6.

The print mechanism will now be described with reference to FIG. 5. The body 2 of the printing device 1 has a supporting wall 22 which can be abutted against the surface to be printed and which defines the print face 24. The print face 24 accommodates an ink jet cartridge 26 which can be replaced when finished using the cartridge release mechanism 8. The ink jet cartridge is mounted for movement along a write axis 28 by virtue of a cooperating lead screw 30 and nut 32. The movement is controlled by a stepper motor 34. The position of the writing axis 28 can be altered by an indexing axis lead screw and bush 36 controlled by a further stepper motor 38. Reference numeral 40 designates a stability bar which extends parallel to the write axis 28, the ink cartridge 26 being mounted between the write axis 28 and the stability bar 40. Reference numeral 42 designates an indexing axis stability bar and bush.

The printing device also includes an electronic controller 100 having a microprocessor for controlling movement of the stepper motor 34 and generating signals for controlling the print head and having a buffer memory for storing data. The microprocessor is capable of converting data from a computer to which the device is connected into a format suitable for driving the printhead. The buffer memory can store information in a variety of formats to enable the printer to work with a variety of computer equipment.

When printing is instigated by pressing the print button 10 on the printing device an image to be printed will be printed a line at a time. Each line could be printed in the same direction (to eliminate backlash errors) or alternatively bi-directionally with the indexing axis stepper motor 38 moving the write axis assembly down one line when the ink-jet head reaches the end. Printing of a six line address for example should then take about 2 or 3 seconds.

The printing device can be powered by rechargeable batteries which, when the device is connected to a computer or word processor terminal, can be trickle charged from a low power source in the computer terminal. The printing device 1 can thus be used either when mounted on a computer terminal or when removed therefrom under the power of its own batteries.

When connected to a computer or word processor terminal, commands to print data can be provided to the printing device from the word processor terminal via the cable 6.

The printing device is particularly suitable for addressing envelopes, parcels etc. An operator of a word processor would insert the address into a letter to be typed and the address data would then pass via the cable 6 to the printing device to be printed on an envelope.

FIGS. 6 to 9 illustrate a second embodiment of the printing device which differs only in its design of body. That is, the second embodiment has a thumb grip for enabling the body 2 to be portable in place of the handle 4 of the first embodiment. The operational functions are as already described with reference to the first embodiment. In FIGS. 6 to 9, like numerals designate like parts as in FIGS. 1 to 5.

We claim:

1. A printing device comprising:

a hand-held portable body which a user positions adjacent a substrate having a printing surface upon which an image is to be printed, the portable body including a print face that is exposed to the printing surface and defines a region within which print is distributable;

an ink jet print head and ink supply mechanism movably mounted within the portable body and being selectively operable at a plurality of locations within the print face to print ink images onto the printing surface without relative movement between the print face and printing surface;

means located within the portable body for moving the print head along at least two orthogonal axes within the print face;

electronic control means including store means for holding data defining at least part of the image; and means controlled by the control means for actuating the print head to print the image.

2. The printing device of claim 1 which further comprises means for holding the substrate adjacent the print face.

3. The printing device of claim 1 wherein the store means comprises a buffer and means for coupling the buffer to a computer terminal for transmission of data from the terminal to the buffer for printing.

4. The printing device of claim 1 wherein the portable body includes a handle for grasping by the user.

5. The printing device of claim 1 wherein the portable body includes a holder which is adapted to be mounted upon a computer terminal.

6. The printing device of claim 1 further comprising alignment means for aligning the printing device with respect to the printing surface on which an image is to be printed.

7. The printing device of claim 6, wherein said alignment means includes a corner having a right angle to allow the printing device in use to be aligned against a corner of an envelope.

8. The printing device of claim 6, which comprises means for holding the substrate against the print head.

9. The printing device of claim 1 further comprising, means for enabling a connection to a word processor terminal to allow address data to be passed from the word processor terminal to said printing device.

10. A hand-held printing device comprising:

a hand-held portable body which a user holds, during printing, adjacent a substrate having a printing surface upon which an image is to be printed, the portable body including a print face that is exposed to the printing surface and defines a region within which print is distributable;

an ink jet print head and ink supply mechanism movably mounted within the portable body and being selectively operable at a plurality of locations within the print face that is exposed to the printing surface without relative movement between the print face and printing surface;

means located within the portable body for moving the print head along at least two orthogonal axes within the print face;

electronic control means including store means for holding data defining at least part of the image; and means controlled by the control means for actuating the print head to print the image.

* * * * *

UNITED STATES PATENT AND TRADEMARK OFFICE

CERTIFICATE OF CORRECTION

PATENT NO. : 5,685,651

DATED : November 11, 1997

INVENTOR(S) : Hayman, et. al.

It is certified that error appears in the above-identified patent and that said Letters Patent is hereby corrected as shown below:

Title page, item [75], Assignee: should read -- Esselte N. V., St. Niklaas, Belgium and The Technology Partnership, Royston, United Kingdom--.

Signed and Sealed this

Second Day of June, 1998

*Attest:*

Bruce Lehman

BRUCE LEHMAN

*Attesting Officer*

*Commissioner of Patents and Trademarks*